United States Patent [19]

Takahashi

[11] Patent Number: 4,978,995

[45] Date of Patent: Dec. 18, 1990

[54] IMAGE FORMING APPARATUS HAVING MEANS FOR DETECTING LOADED UNIT

[75] Inventor: Harumi Takahashi, Yokohama, Japan

[73] Assignee: Ricoh Company, Ltd., Tokyo, Japan

[21] Appl. No.: 399,154

[22] Filed: Aug. 28, 1989

[30] Foreign Application Priority Data

Sep. 9, 1988 [JP] Japan ..... 63-224692

[51] Int. Cl.[5] ..... G03G 15/00

[52] U.S. Cl. ..... 355/206; 355/211; 355/260

[58] Field of Search ..... 355/203, 204, 206, 208, 355/210, 211, 260; 382/1; 194/328, 330; 340/568, 571, 572, 825.31, 825.34

[56] References Cited

U.S. PATENT DOCUMENTS 4,500,195 2/1985 Hosono ..... 355/208

FOREIGN PATENT DOCUMENTS 0261643 3/1988 European Pat. Off. .

*Primary Examiner*—Joan H. Pendergrass

*Attorney, Agent, or Firm*—Cooper & Dunham

[57] ABSTRACT

An image forming apparatus includes a mechanism for detecting whether or not a detachably loaded maintenance unit is a genuine unit. A holding part holds the maintenance unit in a predetermined position by applying a predetermined pressure on the maintenance unit. A first engaging part is formed on a genuine maintenance unit, and a second engaging part is formed on the holding part. This second engaging part has a pressure conductive material provided thereon, and the first and second engaging parts have shapes such that one fits into the other when the genuine maintenance unit is in the predetermined position. A detecting part detects whether or not the genuine maintenance unit is in the predetermined position by detecting a change in a resistance of the pressure conductive material.

10 Claims, 8 Drawing Sheets

IMAGE FORMING APPARATUS HAVING MEANS FOR DETECTING LOADED UNIT

BACKGROUND OF THE INVENTION

The present invention generally relates to image forming apparatuses, and more particularly to an image forming apparatus which detects whether or not a loaded maintenance unit conforms to functions of the image forming apparatus. The maintenance unit refers to units such as a photosensitive unit and a developing unit which are detachably loaded with respect to the image forming apparatus and usually need to be attended to periodically.

Conventionally, the image forming apparatus which has the detachable maintenance unit is provided with a means such as a switch and a relay for detecting whether or not the maintenance unit is correctly loaded into a predetermined position within the image forming apparatus. However, such a means detects that the maintenance unit is loaded into the predetermined position regardless of whether or not the maintenance unit is treated (authorized or approved) as a genuine part by the manufacturer of the image forming apparatus.

A non-genuine maintenance unit is often poor in quality compared to a genuine maintenance unit and the non-genuine maintenance unit cannot fully bring out the intended functions of the image forming apparatus. For example, in a case where a non-genuine developing unit is loaded into the image forming apparatus, a correct image formation cannot be guaranteed due to differences in the characteristics of toners of the non-genuine developing unit and the genuine developing unit. Therefore, the conventional image forming apparatus suffers problems in that the functions of the image forming apparatus may deteriorate and a trouble may occur when the non-genuine maintenance unit is loaded into the image forming apparatus, because the image forming apparatus only has the means for detecting whether or not the maintenance unit is correctly loaded into the predetermined position within the image forming apparatus.

SUMMARY OF THE INVENTION

Accordingly, it is a general object of the preset invention to provide a novel and useful image forming apparatus in which the problems described above are eliminated.

Another and more specific object of the preset invention is to provide an image forming apparatus which includes means for detecting whether or not a detachably loaded maintenance unit is a genuine unit. According to the image forming unit of the present invention, it is possible to fully bring out the functions of the image forming apparatus and thus improve the reliability of the image forming apparatus.

Still another object of the present invention is to provide an image forming apparatus which includes means for detecting whether or not a detachably loaded maintenance unit is a genuine unit, and means for disabling an operation of the image forming apparatus when the detected maintenance unit is not a genuine maintenance unit. According to the image forming unit of the present invention, it is possible to ensure a correct operation of the image forming apparatus and thus prevent a deterioration of the functions and troubles from occurring in image forming apparatus.

A further object of the present invention is to provide an image forming apparatus which includes means for detecting whether or not a detachably loaded maintenance unit is a genuine unit, and means for informing the user when the detected maintenance unit is not a genuine maintenance unit. According to the image forming unit of the present invention, it is possible to ensure a correct operation of the image forming apparatus and thus prevent a deterioration of the functions and troubles from occurring in image forming apparatus, because the user is informed when a non-genuine unit is loaded.

Other objects and further features of the present invention will be apparent from the following detailed description when read in conjunction with the accompanying drawings.

DESCRIPTION OF THE PREFERRED EMBODIMENTS

Figure 1:
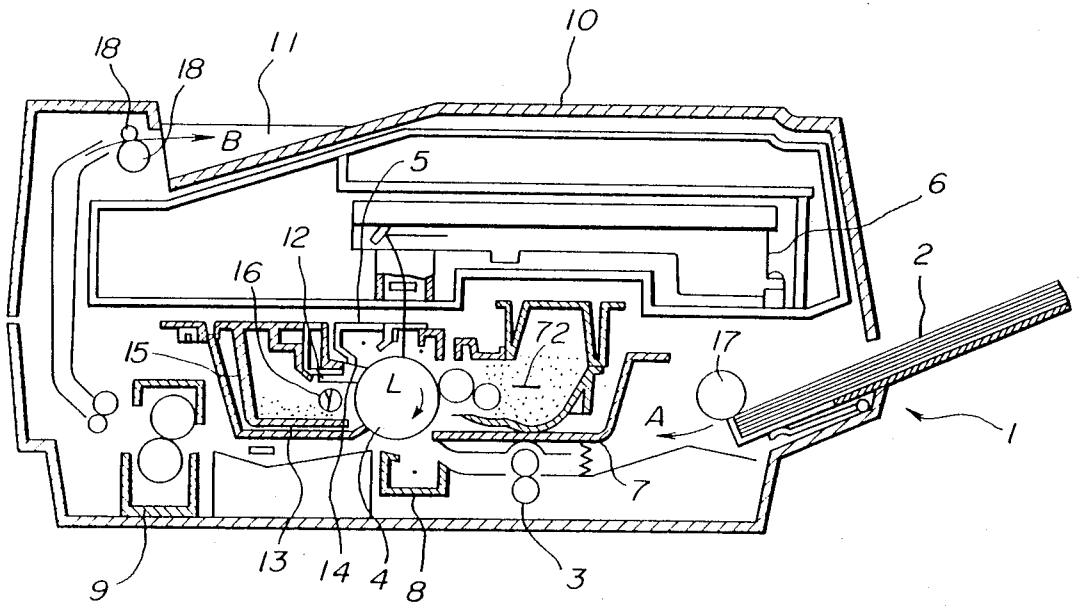
FIG. 1 is a cross sectional view showing an embodiment of an image forming apparatus according to the present invention.

FIG. 1 shows an embodiment of an image forming apparatus according to the present invention. In this embodiment, the present invention is applied to a laser printer. In FIG. 1, a recording sheet 2 which is supplied in a direction A from a paper supplying unit 1 by a paper supplying roller 17. The paper supplying timing is adjusted by a resist roller pair 3 and the recording sheet 2 is directed towards a drum-shaped photosensitive body 4.

The photosensitive body 4 is rotated clockwise. A charger 5 charges a surface of the photosensitive body 4 as the photosensitive body 4 rotates, and a laser optical system 6 irradiates a laser beam L on the surface of the photosensitive body 4 so as to form an electrostatic image. This electrostatic image which is formed on the surface of the photosensitive body 4 is visualized into a toner image by a developing device 7. A transfer charger 8 transfers the toner image onto the recording sheet 2 which is supplied to the photosensitive body 4. The toner image which is transferred onto the recording sheet 2 is fixed by a fixing unit 9, and the recording sheet 2 is thereafter ejected in a direction B to an ejection part 11 by ejection rollers 18.

On the other hand, after the toner image is transferred onto the recording sheet 2, the residual toner on the surface of the photosensitive body 4 is removed by cleaning blades 12 of a cleaning unit 13, and the surface of the photosensitive body 4 is discharged by a discharge brush 14. The residual toner which is removed from the surface of the photosensitive body 4 is collected into a collection chamber 15 by a collection roller 16.

The various parts of the laser printer described above are generally accommodated within a main printer body 10.

Figure 2:
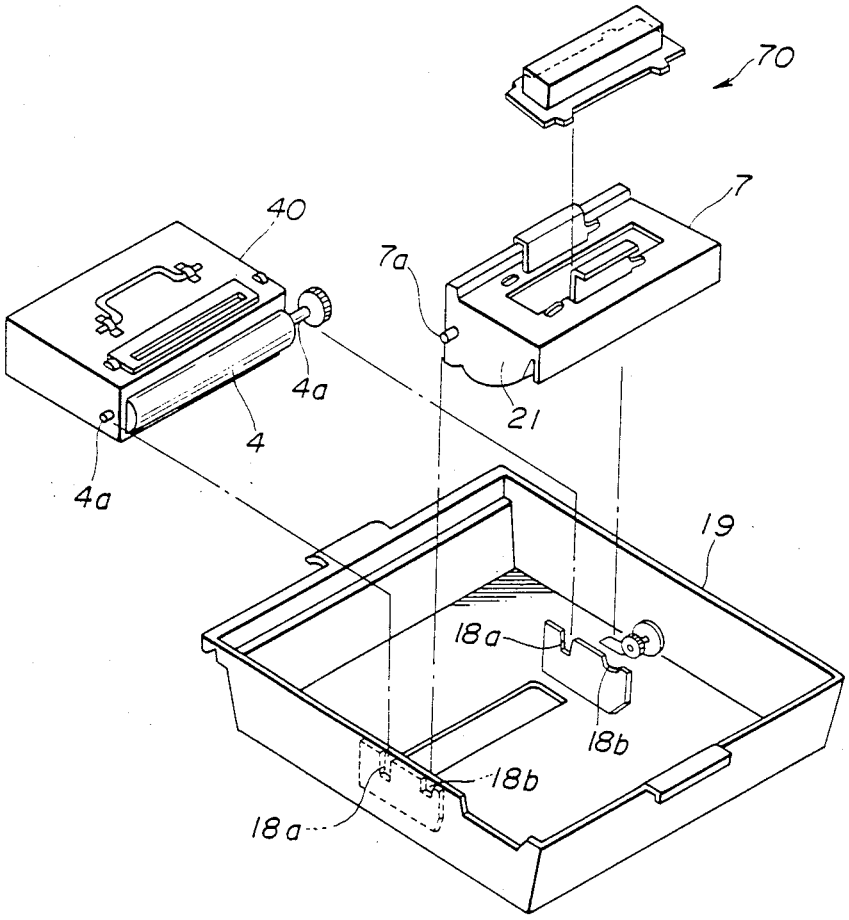
FIG. 2 is a disassembled perspective view showing an essential part of the embodiment for explaining loading and unloading of maintenance units.

Various maintenance units of the laser printer shown in FIG. 1 are detachably loaded into a positioning frame 19 shown in FIG. 2, for example. In FIG. 2, the maintenance units are a photosensitive unit 40 which comprises the photosensitive body 4, and a developing unit 70 which comprises the developing device 7. The photosensitive unit 40 has shafts 4*a* which fit into corresponding cutouts 18*a* of the positioning frame 19 when the photosensitive unit 40 is loaded into the positioning frame 19. Similarly, the developing unit 70 has shafts 7*a* which fit into corresponding cutouts 18*b* of the positioning frame 19 when the developing unit 70 is loaded into the positioning frame 19. The positioning of the photosensitive unit 40 and the developing unit 70 with respect to each other is achieved by the cooperation of the shafts 4*a* and 7*a* and the cutouts 18*a* and 18*b*.

Figure 3:
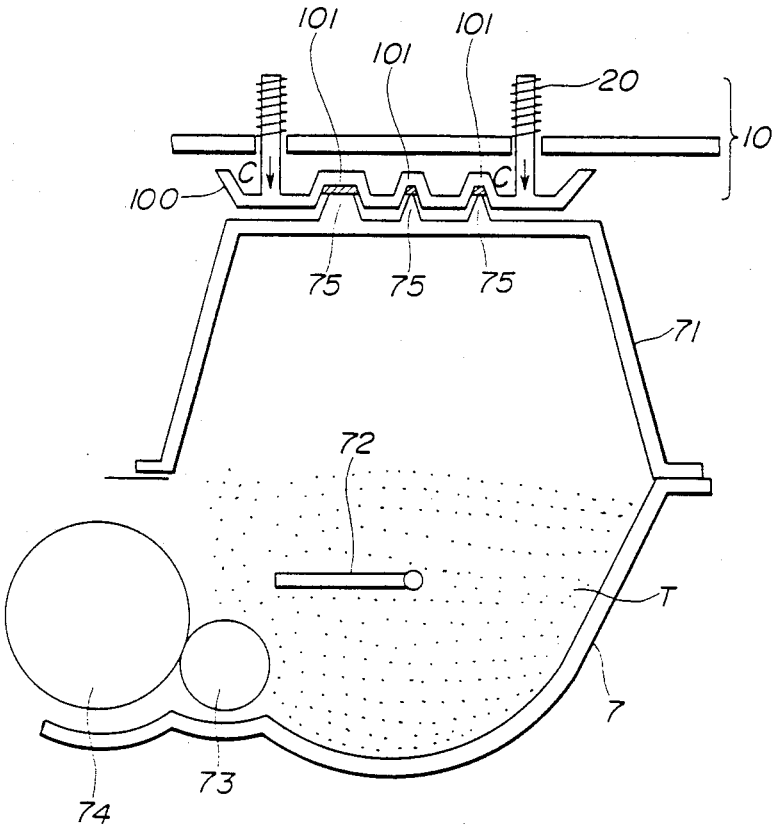
FIG. 3 is a cross sectional view on an enlarged scale showing an essential part of a toner cartridge.

Next, a description will be given of this embodiment by taking the developing unit 70 as an example of the maintenance unit which is loaded into and unloaded from the main printer body 10 of the laser printer. As shown in FIG. 3, an agitator 72 for agitating a toner T, a toner supply roller 73, and a developing roller 74 are provided within a toner cartridge 71 which constitutes the developing unit 70. Projections 75 having a predetermined shape are formed on a top portion of the toner cartridge 71. In this embodiment, the projections 75 are shaped to spell out "RICOH" which is a registered trademark of the manufacturer of the laser printer.

A toner cartridge holder 100 is provided on the main printer body 10. This toner cartridge holder 100 holds down the toner cartridge 71 in a direction C by the action of springs 20. Depressions 101 for receiving the corresponding projections 75 are formed on the toner cartridge holder 100, and these depressions 101 have a shape corresponding to that of the projections 75. In other words, the projections 75 fit into the corresponding depressions 101.

Figure 4:
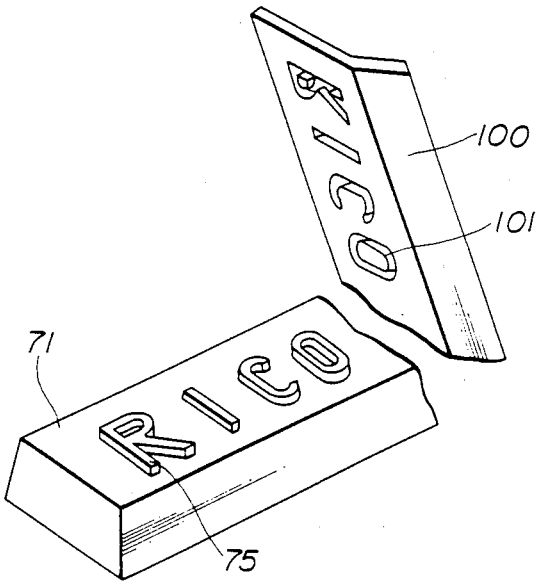
FIG. 4 is a perspective view showing essential parts of engaging parts of the image forming apparatus and the toner cartridge.

FIG. 4 shows the external appearance of an essential part of the projections 75 and the corresponding depressions 101. Because the projections 75 and the corresponding depressions 101 are shaped as shown, a predetermined pressure acts on the projections 75 of the toner cartridge 71 and to the toner cartridge holder 100 of the main printer body 10 by the action of the springs 20 when the toner cartridge 71 is loaded into a predetermined position within the main printer body 10, and the projections 75 fit into the corresponding depressions 101.

This embodiment is not only characterized by the predetermined shapes of the engaging parts which are the projections 75 and the corresponding depressions 101 and the positioning of the toner cartridge 71 provided thereby. As will be described later in the specification, it is possible to discriminate whether or not the loaded toner cartridge 71 is treated (authorized or approved) as a genuine part by the manufacturer of the laser printer based on a change in the resistance of the engaging parts.

Figure 5:
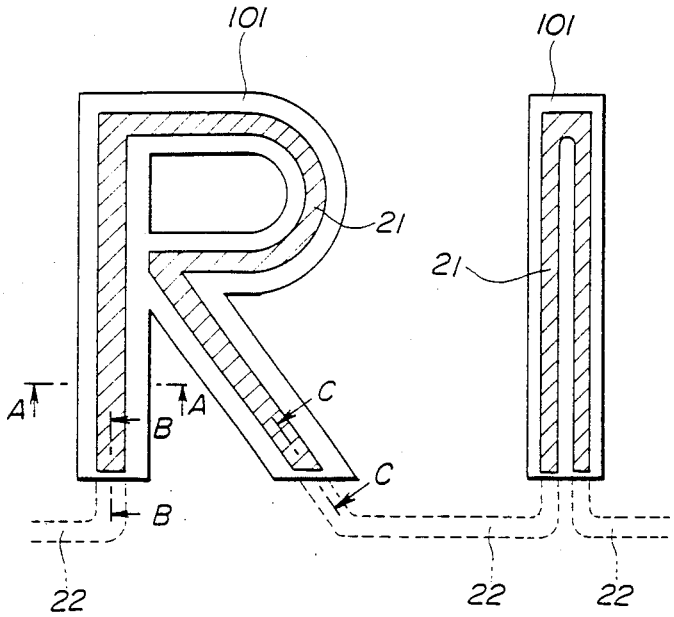
FIG. 5 is a plan view for explaining connections of a pressure conductive material which is embedded in the engaging part and a conductive material.
Figure 6:
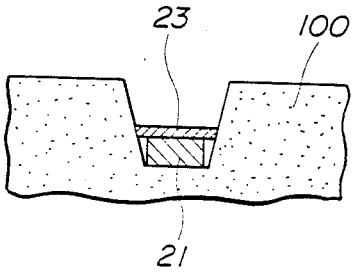
FIG. 6 is a cross sectional view taken along a line A—A in FIG. 5.
Figure 7:
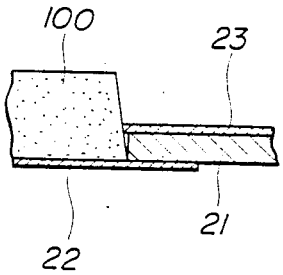
FIG. 7 is a cross sectional view taken along lines B—B and C—C in FIG. 5.

FIGS. 5 through 7 show an essential part of an embodiment of an arrangement of a pressure conductive material 21 which is embedded in the depressions 101 of the toner cartridge holder 100 and a conductive material 22 which connects the characters "R", "I", . . . , and "H" which constitute the predetermined shape. FIG. 5 is a plan view showing the pressure conductive material 21 which are shaped into the characters "R" and "I" and the conductive material 22 which is indicated by a phantom line and constitute an interconnection. FIG. 6 is a cross sectional view taken along a line A—A in FIG. 5, and FIG. 7 is a cross sectional view taken along lines B—B and C—C in FIG. 5.

As may be seen from FIG. 6, the pressure conductive material 21 is covered with an insulating sheet 23 which protects the conductive material from external dust particles or the like and also improves the mechanical strength. In FIG. 7 which shows the cross section at the terminal, the pressure conductive material 21 and the conductive material 22 connect, and the pressure conductive material 21 which is embedded in the depression 101 is fixed to a substrate (insulator) of the main printer body 10 by an adhesive agent or the like.

The pressure conductive material 21 may be obtained by dispersing fine metal grains into a silicon rubber. For example, a pressure conductive rubber (pressure conductor) JSR-PCR101 manufactured by Japan Synthetic Rubber Co., Ltd. of Japan may be used for the pressure conductive material 21. The pressure conductive rubber JSR-PCR101 has a superior dynamic characteristic as a rubber, and has a resistance of $10^6$ Ohm·m or greater under no pressure and a resistance of 1 Ohm·m or less when a pressure in the order of 100 g/cm$^2$ is applied thereon.

Figure 8:
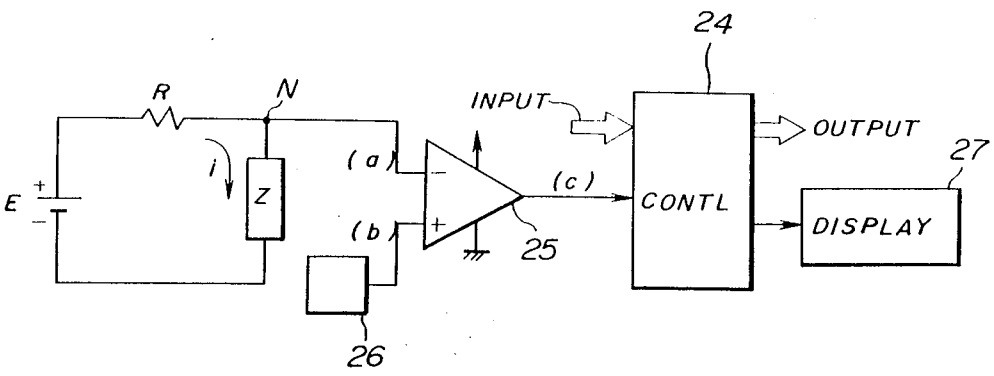
FIG. 8 is a circuit diagram showing an embodiment of a detection circuit.
Figure 9:
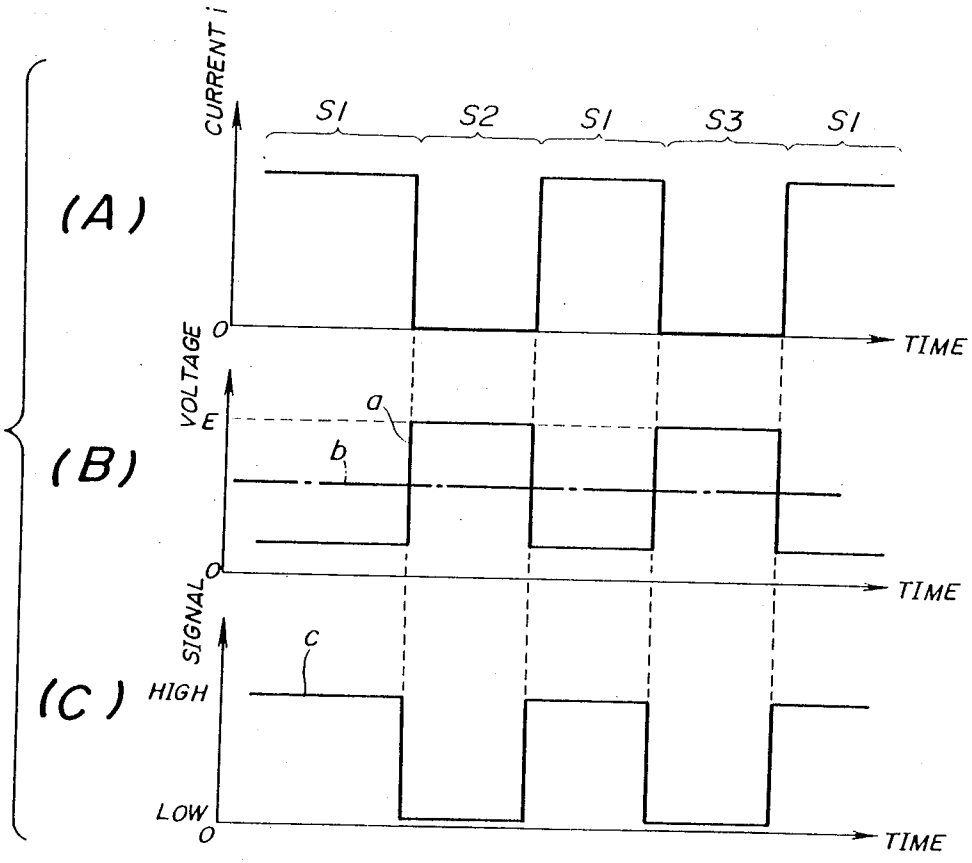
FIGS. 9(A) through 9(C) show signal waveforms for explaining an operation of the detection circuit shown in FIG. 8.

FIG. 8 shows an embodiment of a detection circuit which detects a change in the resistance of the pressure conductive material 21 and supplies a detection signal to a main control unit 24 of the main printer body 10. FIGS. 9(A) through 9(C) show signal waveforms for explaining an operation of the detection circuit shown in FIG. 8.

In FIG. 8, a closed circuit is formed by a D.C. current source E, a resistor R, and a resistance Z of the pressure conductive material 21. A current which flows through this closed circuit is denoted by i. A comparator 25 receives a reference voltage signal b which is output from a reference voltage generator 26 and a signal a which is received from a node N which connects the resistor R and the resistance Z.

As shown in FIG. 9(A), the current i flows from the D.C. current source E to the pressure conductive material 21 in a normal state S1 where the projections 75 engage the corresponding depressions 101 with the predetermined pressure. But in a state S2 where a cover (not shown) of the main printer body 10 is open and in a state S3 where no toner cartridge is loaded or the loaded toner cartridge is a non-genuine part, the depressions 101 do not engage corresponding projections of the toner cartridge 71 with the predetermined pressure, and the current i does not flow. As shown in FIG. 9(B), the signal a has a low level in the state S1 and a high level in the states S2 and S3 with respect to the reference voltage signal b which is output from the reference voltage generator 26. Accordingly, the comparator 25 compares the two signals a and b and outputs a detection signal c which has a level dependent on the resistance Z. In other words, the change in the resistance Z can be detected from the detection signal c.

FIG. 9(C) shows the output detection signal c of the comparator 25. The detection signal c has a high level in the state S1 and a low level in the states S2 and S3. A main control unit 24 receives the detection signal c output from the comparator 25 and controls the operation of the laser printer. For example, the main control unit 24 automatically disables the operation of the laser printer when the received detection signal c has a low level, that is, when the resistance Z is less than a predetermined value. As an alternative, the main control unit 24 may send a signal to a display device 27 of the main printer body 10 and display thereon a message which warns the user that no toner cartridge is loaded or the loaded toner cartridge is a non-genuine part. It is also possible to inform the user by sound or speech synthesis.

It is of course possible to form depressions on the toner cartridge 71 and form projections on the toner cartridge holder 100. In this case, the pressure conductive material is provided on top of the projections on the toner cartridge holder 100.

In the above described embodiment, the toner cartridge 71 is taken as an example of the maintenance unit. However, the maintenance units may of course include other units such as a photosensitive unit, a cleaning unit and a charger unit.

In addition, the present invention is applicable to image forming apparatuses other than the laser printer, such as a copying machine and a facsimile machine.

Further, the present invention is not limited to these embodiments, but various variations and modifications may be made without departing from the scope of the present invention.

What is claimed is:

1. An image forming apparatus comprising:

a main body;

at least one maintenance unit which is loaded into a predetermined position within said main body, said maintenance unit being detachable from the predetermined position;

holding means for holding said maintenance unit in the predetermined position by applying a predetermined pressure on said maintenance unit;

a first engaging part formed on said maintenance unit;

a second engaging part formed on said holding means and having a pressure conductive material provided thereon, said first and second engaging parts having shapes such that one fits into the other when said maintenance unit is in the predetermined position; and detecting means for detecting whether or not said maintenance unit is in the predetermined position by detecting a change in a resistance of said pressure conductive material.

2. The image forming apparatus as claimed in claim 1 wherein said first engaging part comprises at least a projection and said second engaging part comprises a depression for receiving the projection, said pressure conductive material being embeddedly provided in the depression.

3. The image forming apparatus as claimed in claim 2 wherein said projection and said depression have corresponding shapes of a character.

4. The image forming apparatus as claimed in claim 1 wherein said detecting means comprises a closed circuit which includes said pressure conductive material, a reference voltage generator for generating a reference voltage, and a comparator for comparing a voltage received from a part of said closed circuit and the reference voltage, said comparator outputting a detection signal which is indicative of the change in the resistance of said pressure conductive material.

5. The image forming apparatus as claimed in claim 1 wherein the predetermined pressure applied by said holding means on said maintenance unit is selected to a value such that the resistance of said pressure conductive material is less than a predetermined value when said maintenance unit is in the predetermined position.

6. The image forming apparatus as claimed in claim 1 which further comprises means for automatically disabling an operation of said image forming apparatus when said detecting means detects no maintenance unit in the predetermined position.

7. The image forming apparatus as claimed in claim 1 which further comprises output means for outputting a message when said detecting means detects no maintenance unit in the predetermined position.

8. The image forming apparatus as claimed in claim 7 wherein said output means includes means for displaying the message when said detecting means detects no maintenance unit in the predetermined position.

9. The image forming apparatus as claimed in claim 1 wherein said detecting means detects that no maintenance unit is loaded in the predetermined position when a maintenance unit in the predetermined position does not have said first engaging part.

10. The image forming apparatus as claimed in claim 1 wherein said maintenance unit is selected from a group which includes a photosensitive unit, a developing unit, a cleaning unit, and a charger unit.

* * * * *